United States Patent [19]

Alsberg

[11] 4,232,249

[45] Nov. 4, 1980

[54] BEAM-SWITCHED TRAVELING WAVE TUBE

[75] Inventor: Dietrich A. Alsberg, Middletown, N.J.

[73] Assignee: Bell Telephone Laboratories, Incorporated, Murray Hill, N.J.

[21] Appl. No.: 946,661

[22] Filed: Sep. 28, 1978

[51] Int. Cl.[2] ..... H01J 25/34

[52] U.S. Cl. ..... 315/3.6; 315/5.24; 315/39.3

[58] Field of Search ..... 315/3.5, 3.6, 39.3, 315/5.24

[56] References Cited

U.S. PATENT DOCUMENTS

| | | | |
|---|---|---|---|
| 2,832,001 | 4/1958 | Adler | 315/3.6 |
| 3,211,945 | 10/1965 | Thon | 315/3.5 |
| 3,258,640 | 6/1966 | Minakovic | 315/3.6 |
| 3,508,110 | 4/1970 | Farney | 315/3.6 X |
| 3,787,747 | 1/1974 | Scott | 315/3.6 |

*Primary Examiner*—Saxfield Chatmon, Jr.
*Attorney, Agent, or Firm*—Erwin W. Pfeifle

[57] ABSTRACT

A traveling wave tube arrangement for use in satellite communications systems is disclosed wherein a plurality of traveling wave tube delay structures and an electron gun are contained in a single envelope with beam deflection apparatus. The electron beam deflection apparatus is disposed between the electron gun and the plural traveling wave tube delay structures to selectively deflect the electron beam to the individual delay structures on a time division basis. In one embodiment, electron beam deflection apparatus is simplified by arranging the individual delay structures radially from a point in the path of the electron stream where the stream is deflected by the beam deflection apparatus.

8 Claims, 4 Drawing Figures

BEAM-SWITCHED TRAVELING WAVE TUBE

BACKGROUND OF THE INVENTION

1. Field of the Invention

This invention relates to microwave amplifiers, and more particularly, to traveling wave tubes of the type wherein a plurality of electron beam modulating delay circuits are contained in an envelope with an electron gun and associated beam deflecting circuitry.

2. Prior Art

It is well known that communication satellites are severely constrained by limitations on maximum size, maximum weight, and maximum available power. These three factors are directly interrelated with one another and with launch cost; the major initial capital investment factor. Efficient use of available satellite power, therefore, is essential to achieving adequate satellite communications capacity at reasonable initial investment.

The more recent designs for communications satellites generally provide a substantial number of electromagnetic energy beams, each of which beams utilizes at least one traveling wave tube microwave amplifier. It is a problem with traveling wave tubes of a type which have heretofore been employed in satellite communications systems, that their characteristics of operation render them wasteful of electrical energy, especially in the idle channel mode. Each traveling wave tube (TWT) contains a relatively inefficient electron beam source which requires very high anode potentials to control the velocity of an electron stream. The basic components and operation of a TWT are explained in a work entitled "Traveling Wave Tubes", by J. R. Pierce (1950).

During such times as the associated channel is not transmitting information, the TWT does not amplify RF signals but will nevertheless draw a substantial share of prime power. In systems operated in a time division multiple access (TDMA) mode, an idle TWT will draw as much as 60 to 70 percent of the power required during continuous RF modulation. Semiconductor switches which, are relatively lossless, can switch anode potentials in the order of several thousand volts, and yet be space qualified for an orbit life of approximately ten years, are not available under present technology.

The current practice under TDMA technology, as applied to communications satellites, is to employ lossy semiconductor switches to transfer an RF signal to individual TWTs associated with respective antenna ports. This practice, of course, does not alleviate the standby power consumption problem associated with TWTs. It would be preferable, therefore, to provide switching at the TWT output. However, semiconductor diode switches cannot reliably switch the high RF power output of the TWTs, and therefore do not satisfy the lifetime requirements of the space environment. Ferrite-type switches can generally switch high RF power levels, but are too slow for TDMA applications. The problem remaining in the prior art, therefore, is to provide an energy efficient microwave amplifier which can operate at high switching speeds in the space environment.

SUMMARY OF THE INVENTION

In accordance with the present invention, the foregoing and other problems of the prior art are solved by providing a plurality of TWT delay lines and associated structures in one envelope with one electron gun, and electron beam deflection apparatus interposed between the electron gun and the plural TWT delay lines.

It is an aspect of the present invention that the electron beam deflection apparatus directs the electron beam to the individual delay lines, on a time division basis, thereby effecting a savings in the required satellite power supply capacity by not providing an electron beam to TWT delay lines associated with idle channels.

It is another aspect of the present invention that, in one embodiment thereof, single or periodic magnet structures which confine the beam and prevent the beam from spreading under space charge can be shared by two or more delay line structures, thereby effecting a substantial savings in weight.

It is a further aspect of an embodiment of the invention that additional weight savings may be achieved by sharing a common collector heat sink between plural TWTs. Such collector heat sinks comprise a major component of TWT weight.

Other and further aspects of the present invention will become apparent during the course of the following description and by reference to the accompanying drawings.

BRIEF DESCRIPTION OF THE DRAWING

Referring now to the drawings, in which like numerals represent like parts in several views.

DETAILED DESCRIPTION

Figure 1:
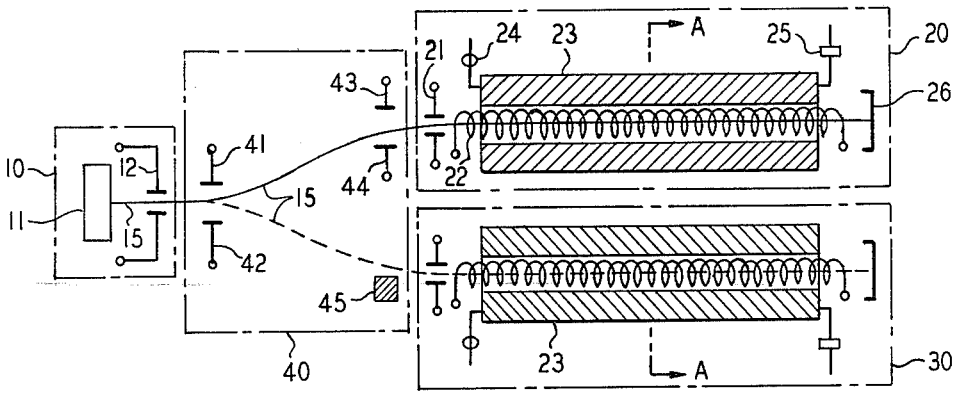
FIG. 1 schematically illustrates a beam-switched TWT wherein the delay lines and associated TWT structures are aligned parallel to each other.

FIG. 1 is a side view of a cross section of a beam-switched traveling wave tube comprised of electron gun 10, delay structures 20 and 30, and beam switch 40 interposed between the electron gun and the delay structures. For the sake of clarity of the drawing, only two identical delay structures, 20 and 30, are shown. However, as will be described in connection with FIGS. 2 and 3, the invention is not limited to only two delay structures.

Electron gun 10 is of conventional design. Cathode 11 emits electrons which are formed into a beam 15 by a first focus lens 12. Electron beam 15 enters beam switch 40 where it is deflected by switching electrodes 41 and 42. The relative potentials on electrodes 41 and 42 determine whether the beam is deflected upwards in FIG. 1 to a delay structure 20 or downwards to a delay structure 30, in response to control signals delivered to the electrodes from control circuitry which is not shown. It is to be understood that reference to electrostatic deflection electrodes 41 and 42 is for the purpose of illustrating an embodiment of the invention. Other electron beam deflection techniques which are known to persons skilled in the art, such as magnetic coil deflection, are devisable without exceeding the scope of the invention.

Once beam 15 has been selectively deflected by electrodes 41 and 42 or their magnetic equivalents mentioned hereinabove, beam 15 will pass electrodes 43 and 44 which function to bend beam 15 so as to align it with the associated delay structure 20 and 30, respectively, toward which it was selectively directed. As is the case with the beam deflection electrodes, magnetic bending apparatus may be substituted for beam bend electrodes 43–44, in FIG. 1. For purposes of illustration, a permanent magnet beam bending arrangement 45 is shown in beam switch 40 near delay structure 30. In embodiments of the invention where compactness of the design is essential, permanent magnets of samarium-cobalt material may be used. However, other magnetic materials or deflection coils may be used to bend the electron beam.

In this illustration of an embodiment of the invention, beam 15 is shown directed to the center of delay structure 20 where it is focused by a second focus lens 21 to correct for defocusing which is caused by the deflection of the beam within beam switch 40. The focused beam is conducted through the center of the coils formed by wire helix 22 where, in this embodiment, the velocity of the electron beam is modulated by the signal impressed upon the wire helix. The velocity-modulated beam is collected by collector 26 in accordance with conventional TWT operation. The invention is not limited to helical modulating structures, and other periodic slow wave structures which are common and well known in the TWT art may be employed to modulate the electron beam. Electromagnetic microwave energy enters the delay structure at waveguide input 24 and exits at microwave waveguide output 25 after being modulated in accordance with the well known principles of TWT operation.

Electron beam 15 is contained within TWT delay structure 20 by operation of a magnetic field produced by a single magnet or a series of permanent magnets which are schematically illustrated in the figure by structure 23. Periodic magnetic focusing is known to persons skilled in the art, and therefore, will not be treated here.

Figure 2:
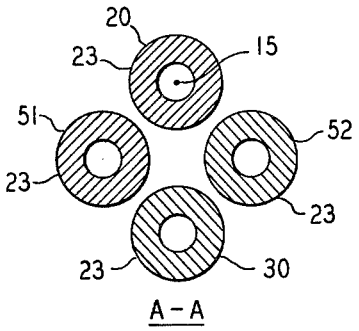
FIG. 2 is a cross-sectional representation of the embodiment of FIG. 1 showing individual magnet structures.

FIG. 2 is a cross-sectional representation of the TWT delay structures of FIG. 1, taken along line A—A. Where the arrangement of FIG. 1 contains, for example, four delay structures, 20, 30, 51, and 52 arranged as shown in FIG. 2, additional beam-deflecting electrodes would be provided and aligned in the plane of and normal to electrodes 41 and 42 to permit deflection of beam 15 towards a selectable one of delay structures 51 and 52. In FIG. 2, delay structure 20 corresponds to the similarly identified delay structure in FIG. 1. Electron beam 15 is cross-sectionally depicted as a dot in this figure. Each of the delay structures 20, 30, 51, and 52 has an associated periodic magnet focusing system 23.

Figure 3:
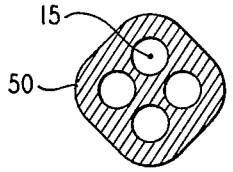
FIG. 3 is a cross-sectional representation of the embodiment of FIG. 1 showing a shared magnet structure.

FIG. 3 is an alternative embodiment wherein the four delay structures of FIG. 2 share a common periodic magnetic structure 50. Again, as is the case in FIG. 2, electron beam 15 is cross-sectionally represented as a dot. It can be seen from reference to FIGS. 2 and 3 that the shared magnet arrangement of FIG. 3 yields a more compact overall physical arrangement. Such compactness, however, is compromised by increased precision of manufacture required to permit alignment of the electron beam within the individual delay structures.

Figure 4:
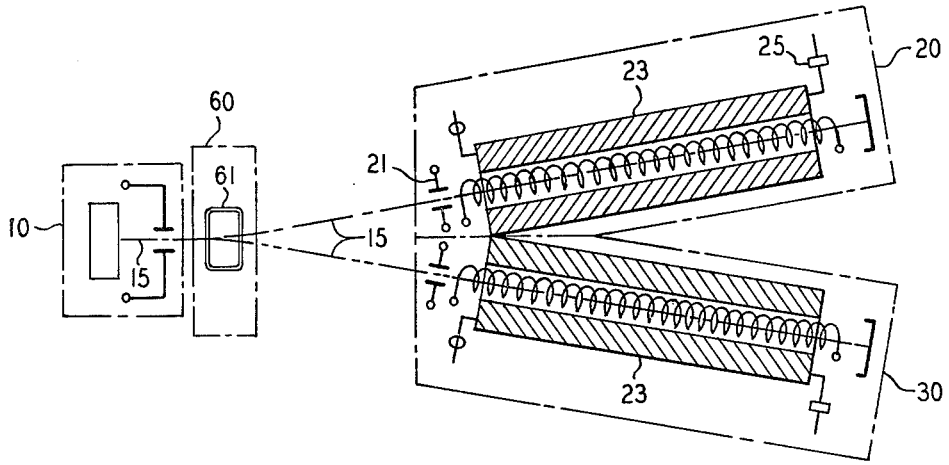
FIG. 4 schematically illustrates an embodiment of the invention wherein the delay lines and associated structures are aligned radially with respect to the point of beam deflection.

FIG. 4 schematically illustrates an embodiment of the invention wherein the delay line structures 20 and 30 are not parallel to one another, but extend radially from a point where electron beam 15 is deflected in a beam switch 60 by deflection coil 61. As is the case in the embodiment of FIG. 1, electron gun 10 generates electron beam 15 which is conducted to beam switch 60. In this embodiment of the invention, magnetic deflection coil 61 serves to switch the electron beam in similar fashion to beam deflecting electrodes 41 and 42 in beam switch 40 in FIG. 1. Beam switch 60 does not contain beam bending permanent magnet or beam bending electrodes analogous to the beam bending electrodes 43 and 44 in beam switch 40 since the beam is directed toward the center of the selected delay structure by deflection coil 61. It is therefore apparent that the radial arrangement of FIG. 4 simplifies the structure of the beam switch. It is to be noted, however, that the shared magnet concept of FIG. 3 cannot be applied to the non-parallel delay structures of the embodiment of FIG. 4. Thus, each of the delay structures 20 and 30 in FIG. 4 contain individual single or periodic focusing arrangements 23, as found in delay structures 20 and 30 of FIG. 2. It is additionally evident from FIG. 4 that the radially disposed delay structures are more widely separated at the outputs which in some spacecraft arrangements can result in a more convenient layout of waveguides connecting the traveling wave tube outputs 25 to the corresponding antenna ports.

The hereinabove described exemplary embodiment is illustrative of the application of the principles of the invention. It is to be understood that, in light of this teaching, numerous other arguments may be devised by persons skilled in the art without departing from the spirit and scope of the invention.

I claim:

1. A traveling wave tube arrangement comprising an electron (10) gun capable of generating a beam (15) of electrons, a first delay structure (20) capable of receiving and modulating the beam of electrons,

CHARACTERIZED IN THAT the traveling wave tube arrangement further comprises n−1 additional delay structures (30), where n is greater than 1, each additional delay structure being disposed so as to be capable of receiving and modulating the beam of electrons; and deflecting means (40) disposed between the electron gun and the n delay structures, said deflecting means selectively deflecting the beam of electrons to any one of the n delay structures.

2. The arrangement of claim 1

CHARACTERIZED IN THAT the n delay structures are disposed parallel to one another.

3. The arrangement of claim 2

CHARACTERIZED IN THAT the deflecting means comprises a first pair of electrodes (41, 42) deflecting the beam of electrons generated by said electron gun to a respective one of the delay structures; and at least a second pair of electrodes (43, 44) bending the selectively deflected beam so as to align the beam with a longitudinal axis of the respective one of the delay structures.

4. The arrangement of claim 3

CHARACTERIZED IN THAT the n delay structures share a common magnet structure (50) confining the selectively deflected beam of electrons to said respective one of the delay structures.

5. The arrangement of claim 1

CHARACTERIZED IN THAT the n delay structures are disposed radially with respect to a predetermined point where the beam of electrons is deflected by the deflecting means.

6. The arrangement of claim 1 or 5

CHARACTERIZED IN THAT the deflecting means comprises a pair of electrodes deflecting the beam of electrons to a respective one of the delay structures.

7. The arrangement of claim 1 or 5

CHARACTERIZED IN THAT the deflecting means comprises a magnetic deflection coil (61) deflecting the beam of electrons to a respective one of the delay structures.

8. The arrangement of claim 2

CHARACTERIZED IN THAT the deflection means comprises a permanent magnet structure (45).

* * * * *